US007357735B2

(12) United States Patent
Sullivan et al.

(10) Patent No.: US 7,357,735 B2
(45) Date of Patent: Apr. 15, 2008

(54) FULLY-NEUTRALIZED IONOMERS FOR USE IN GOLF BALL HAVING A LARGE CORE AND A THIN, DENSE LAYER

(75) Inventors: Michael J. Sullivan, Barrington, RI (US); Derek A. Ladd, Acushnet, MA (US); Antonio U. DeSimas, East Providence, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/695,648

(22) Filed: Apr. 3, 2007

(65) Prior Publication Data

US 2007/0173351 A1 Jul. 26, 2007

Related U.S. Application Data

(60) Continuation-in-part of application No. 11/470,350, filed on Sep. 6, 2006, which is a continuation of application No. 10/974,144, filed on Oct. 27, 2004, now abandoned, which is a division of application No. 10/157,679, filed on May 29, 2002, now Pat. No. 6,852,042, which is a continuation-in-part of application No. 09/842,574, filed on Apr. 26, 2001, now Pat. No. 6,533,682, which is a continuation-in-part of application No. 09/815,753, filed on Mar. 23, 2001, now Pat. No. 6,494,795.

(51) Int. Cl.
*A63B 37/06* (2006.01)

(52) U.S. Cl. ..... 473/374

(58) Field of Classification Search ..... 473/374, 473/373, 376, 367
See application file for complete search history.

(56) References Cited

U.S. PATENT DOCUMENTS

| | | | |
|---|---|---|---|
| 4,431,193 | A | 2/1984 | Nesbitt |
| 4,625,964 | A | 12/1986 | Yamada |
| 5,048,838 | A | 9/1991 | Chikaraishi et al. |
| 5,104,126 | A | 4/1992 | Gentiluomo |
| 5,184,828 | A | 2/1993 | Kim et al. |
| 5,334,673 | A | 8/1994 | Wu |
| 5,482,285 | A | 1/1996 | Yabuki et al. |
| 5,484,870 | A | 1/1996 | Wu |
| 5,692,974 | A | 12/1997 | Wu et al. |
| 5,703,166 | A | 12/1997 | Rajagopalan et al. |
| 5,704,854 | A | 1/1998 | Higuchi et al. |
| 5,733,428 | A | 3/1998 | Calabria et al. |
| 5,783,293 | A | 7/1998 | Lammi |
| 5,810,678 | A | 9/1998 | Cavallaro et al. |
| 5,823,889 | A | 10/1998 | Aoyama |
| 5,824,746 | A | 10/1998 | Harris et al. |
| 5,876,294 | A | 3/1999 | Yamagishi et al. |
| 5,885,172 | A | 3/1999 | Hebert et al. |
| 5,908,358 | A | 6/1999 | Wu |
| 5,919,100 | A | 7/1999 | Boehm et al. |
| 5,947,843 | A | 9/1999 | Calabria et al. |
| 5,981,658 | A | 11/1999 | Rajagopalan et al. |
| 5,989,136 | A | 11/1999 | Renard et al. |
| 5,993,968 | A | 11/1999 | Umezawa et al. |
| 6,010,411 | A | 1/2000 | Reyes |
| 6,010,412 | A | 1/2000 | Moriyama |
| 6,025,442 | A | 2/2000 | Harris et al. |
| 6,030,296 | A | 2/2000 | Morgan et al. |
| 6,045,460 | A | 4/2000 | Hayashi et al. |
| 6,056,842 | A | 5/2000 | Boehm et al. |
| 6,068,561 | A | 5/2000 | Renard et al. |
| 6,071,201 | A | 6/2000 | Maruko |
| 6,102,815 | A | 8/2000 | Sutherland |
| 6,120,393 | A | 9/2000 | Sullivan et al. |
| 6,142,887 | A | 11/2000 | Sullivan et al. |
| 6,149,535 | A | 11/2000 | Bissonnette et al. |
| 6,152,834 | A | 11/2000 | Sullivan |
| 6,180,722 | B1 | 1/2001 | Dalton et al. |
| 6,220,972 | B1 | 4/2001 | Sullivan et al. |
| 6,248,027 | B1 | 6/2001 | Hayashi et al. |
| 6,267,692 | B1 | 7/2001 | Higuchi et al. |
| 6,277,034 | B1 | 8/2001 | Nesbitt et al. |
| 6,302,808 | B1 | 10/2001 | Dalton et al. |
| 6,482,109 | B2 | 11/2002 | Nesbitt et al. |
| 6,494,795 | B2 | 12/2002 | Sullivan |
| 6,533,682 | B2 | 3/2003 | Sullivan |
| 6,595,874 | B2 | 7/2003 | Sullivan et al. |
| 6,616,550 | B2 | 9/2003 | Nesbitt et al. |
| 6,616,551 | B2 | 9/2003 | Nesbitt et al. |
| 6,635,716 | B2 | 10/2003 | Voorheis et al. |

(Continued)

FOREIGN PATENT DOCUMENTS

| | | |
|---|---|---|
| WO | WO0023519 | 4/2000 |

(Continued)

*Primary Examiner*—Raeann Trimiew
(74) *Attorney, Agent, or Firm*—William B. Lacy

(57) ABSTRACT

A golf ball comprising a core comprising a highly-neutralized thermoplastic polymer formed from a copolymer of ethylene and an α,β-unsaturated carboxylic acid, a salt of an organic acid, and sufficient cation source to filly-neutralize the acid groups of the copolymer; an outer cover layer; and an inner cover layer disposed between the center and the outer cover layer, the inner cover layer having a specific gravity of 2.5 g/cc or greater; wherein the core has an outer diameter of 1.58 inches or greater and a coefficient of restitution of 0.805 or greater when measured at an incoming velocity of 125 ft/s.

20 Claims, No Drawings

U.S. PATENT DOCUMENTS

| | | | |
|---|---|---|---|
| 6,638,184 | B2 | 10/2003 | Nesbitt et al. |
| 6,653,382 | B1 | 11/2003 | Statz et al. |
| 6,685,580 | B2 | 2/2004 | Sullivan |
| 6,743,123 | B2 | 6/2004 | Sullivan |
| 6,852,042 | B2 | 2/2005 | Sullivan et al. |
| 6,913,547 | B2 | 7/2005 | Cavallaro |
| 6,945,878 | B2 | 9/2005 | Binette et al. |
| 2001/0016524 | A1 | 8/2001 | Sullivan et al. |
| 2003/0050373 | A1 | 3/2003 | Chen |
| 2003/0114565 | A1 | 6/2003 | Chen |
| 2003/0130434 | A1 | 7/2003 | Statz et al. |
| 2005/0267240 | A1 | 12/2005 | Chen |

FOREIGN PATENT DOCUMENTS

| | | |
|---|---|---|
| WO | WO0057962 | 10/2000 |
| WO | WO0129129 | 4/2001 |

FULLY-NEUTRALIZED IONOMERS FOR USE IN GOLF BALL HAVING A LARGE CORE AND A THIN, DENSE LAYER

CROSS-REFERENCE TO RELATED APPLICATIONS

This application is a continuation-in-part of U.S. patent application Ser. No. 11/470,350, filed Sep. 6, 2006, which is a continuation of U.S. patent application Ser. No. 10/974,144 filed on Oct. 27, 2004, now abandoned, which is a divisional application of U.S. application Ser. No. 10/157,679, filed on May 29, 2002 and issued as U.S. Pat. No. 6,852,042, which is a continuation-in-part of application Ser. No. 09/842,574, filed on Apr. 26, 2001 and issued as U.S. Pat. No. 6,533,682, which is a continuation-in-part of application Ser. No. 09/815,753, filed on Mar. 23, 2001 and issued as U.S. Pat. No. 6,494,795. The disclosures of the parent applications are incorporated herein by reference in their entireties.

FIELD OF THE INVENTION

The present invention relates to golf balls and more particularly, the invention is directed to golf balls with improved coefficient of restitution and spin rate.

BACKGROUND OF THE INVENTION

The spin rate of golf balls is the end result of many variables, one of which is the distribution of the density or specific gravity within the ball. Spin rate is an important characteristic of golf balls for both skilled and recreational players. High spin rates allow more skilled players, such as PGA professionals, to maximize control of the golf ball. A high spin rate golf ball is particularly advantageous for an approach shot to the green. The ability to impart back spin to stop the ball on the green and side spin to draw or fade the ball substantially improves a player's control ability to control the golf ball. Hence, the more skilled players generally prefer a golf ball that exhibits high spin rate, in part, off scoring irons, such as the 7-iron club through the pitching wedge.

On the other hand, the recreational players who cannot intentionally control the spin of the ball generally do not prefer a high spin rate golf ball. For these players, slicing and hooking the ball are the more immediate obstacles. When a club head strikes a ball improperly, an unintentional side spin is often imparted to the ball, which can divert the ball from its intended course. Side spin also reduces the direct-line distance the ball will travel. A golf ball that spins less will help minimize the effect of a ball that is not hit squarely with the club face. Hence, recreational players typically prefer a golf ball that exhibits low spin rate.

Reallocating the density or specific gravity of the various layers of a golf ball provides an important means of controlling the spin rate. In some instances, the weight from the outer portions of the ball is redistributed toward the center to decrease the moment of inertia, thereby increasing the spin rate. In other instances, the weight from the inner portion of the ball is redistributed outward to increase the moment of inertia, thereby decreasing the spin rate.

The redistribution of weight within the golf ball is typically accomplished by adding fillers to the inner core or to an outer layer of the golf ball. Conventional fillers include the high specific gravity fillers, such as metal or metal alloy powders, metal oxide, metal searates, particulates, carbonaceous materials, or low specific gravity fillers, such as hollow spheres, microspheres or foamed particles. However, the addition of fillers may adversely interfere with the inherent resiliency of the polymers used in golf balls and thereby the coefficient of restitution of the golf balls. Hence, there remains a need in the art for a golf ball with controlled moment of inertia that has improved coefficient of restitution.

SUMMARY OF THE INVENTION

The present invention is directed to a golf ball comprising a core comprising a highly-neutralized thermoplastic polymer formed from a copolymer of ethylene and an α,β unsaturated carboxylic acid, a salt of an organic acid, and sufficient cation source to fully-neutralize the acid groups of the copolymer; an outer cover layer; and an inner cover layer disposed between the center and the outer cover layer, the inner cover layer having a specific gravity of 2.5 g/cc or greater; wherein the core has an outer diameter of 1.58 inches or greater and a coefficient of restitution of 0.805 or greater Preferably, the cation source is a metal cation of lithium, sodium, potassium, magnesium, calcium, barium, lead, tin, zinc, or aluminum. The salt of an organic acid may be an organic acid, such as aliphatic organic acids, aromatic organic acids, saturated mono- or multi-functional organic acids, unsaturated mono- or multi-functional organic acids, and multi-unsaturated mono- or multi-functional organic acids. The salt of an organic acid is preferably stearic acid, behenic acid, erucic acid, oleic acid, linoelic acid or dimerized derivatives thereof, whereas the salt of an organic acid is typically a cation, such as barium, lithium, sodium, zinc, bismuth, chromium, cobalt, copper, potassium, strontium, titanium, tungsten, magnesium, cesium, iron, nickel, silver, aluminum, tin, or calcium.

The specific gravity of the inner cover layer is preferably 6.0 g/cc or greater, more preferably 8.0 g/cc or greater. In one embodiment, the specific gravity of the inner cover layer is 19 g/cc. While any method may be used to form the cover layer, it is preferred that the outer cover layer be injection molded, cast, reaction injection molded, or compression molded over the core, most preferably cast. The outer cover layer preferably is formed from a polyurethane material, a polyurea material, a polyurethane-urea hybrid material, or a polyurea-urethane hybrid material.

Because the core of the invention is intended to me relatively large, the core outer diameter is preferably 1.58 inches to 1.62 inches, most preferably 1.59 inches. The inner cover layer has a thickness of 0.005 inches or greater, preferably between 0.005 inches and 0.015 inches. The core, whether a single or multi-layer core, preferably has an Atti compression of 75 to 85, most preferably 75, and a Shore D hardness of 42 to 48. When a multi-layer is desired, the core may include a center and at least one outer core layer, which may or may not be of the same material as the center. Preferably the outer core layer, if present, is based on the same material as the core. The inner cover layer may be formed from a thermoset or thermoplastic material, but preferably includes a highly-neutralized thermoplastic polymer formed from a copolymer of ethylene and an α,β unsaturated carboxylic acid, a salt of an organic acid, and sufficient cation source to fully-neutralize the acid groups of the copolymer. The inner cover layer generally has a Shore D hardness of 60 or greater.

The present invention is also directed to a golf ball comprising a core comprising a center and an outer core layer, both the center and outer core layers comprising a highly-neutralized thermoplastic polymer formed from a copolymer of ethylene and an α,β unsaturated carboxylic acid, a salt of an organic acid, and sufficient cation source to fully-neutralize the acid groups of the copolymer; an outer cover layer; and an inner cover layer disposed between the center and the outer cover layer, the inner cover layer having a specific gravity of 4.0 g/cc or greater; wherein the core has an outer diameter of 1.58 inches or greater and a coefficient of restitution of 0.805 or greater.

The present invention is further directed to a golf ball comprising a core having a first specific gravity and comprising a highly-neutralized thermoplastic polymer formed from a copolymer of ethylene and an α,β unsaturated carboxylic acid, a magnesium salt of an organic acid, and sufficient cation source to fully-neutralize the acid groups of the copolymer; a outer cover layer comprising a castable polyurea, polyurethane, or a mixture thereof, and having a thickness of 0.005 inches to 0.015 inches and a Shore D hardness of 60 or greater; and an inner cover layer disposed between the center and the outer cover layer, the inner cover layer comprising the highly-neutralized thermoplastic polymer and having a second specific gravity at least 5 times greater than the first specific gravity; wherein the core has an outer diameter of 1.58 inches to 1.62 inches and a coefficient of restitution of 0.810 or greater.

DETAILED DESCRIPTION OF THE INVENTION

The golf balls of the present invention include a core and a cover surrounding the core. The core and/or the cover may have more than one layer. For example, the core of the golf ball may comprise a single, solid sphere or may be a solid center surrounded by an outer core layer. The center of the core may also be a liquid-filled or hollow sphere. The core may also comprise a center around which tensioned elastomeric material is wound. The cover layer may be a single layer or, for example, formed of a plurality of layers, such as an inner cover layer and an outer cover layer. Any of the golf ball layers may be weighted to adjust the moment of inertia (and therefore the spin) of the golf ball. A preferred construction includes a large core over which is formed a thin, dense inner cover layer and a thin outer cover layer.

Redistributing the mass of the ball either toward the center of the ball or toward the outer surface of the ball changes the dynamic characteristics of the ball at impact and in flight. If the density is shifted or redistributed toward the center of the ball, the moment of inertia is reduced, and the initial spin rate of the ball as it leaves the golf club would increase due to lower resistance from the ball's moment of inertia. Conversely, if the density is shifted or redistributed toward or within the outer cover, the moment of inertia is increased, and the initial spin rate of the ball as it leaves the golf club would decrease due to the higher resistance from the ball's moment of inertia.

In accordance to one aspect of the present invention, as described above, the golf ball comprises a large core, a thin, dense inner cover layer, and an outer cover layer. A preferred way to redistribute the weight of the golf ball is by adding dense (high specific gravity) fillers to a selected portion of the golf ball to achieve a desirable moment of inertia. As used herein the term "fillers" include any compound or composition that can be used to vary the density or specific gravity of selected portions of the golf ball. A combination of increasing the density of outer layers with decreasing the density of the core will also have the same effect. As such, for alternative embodiments, fillers may also include low density fillers. Preferably the inner cover layer (dense or otherwise) has a specific gravity at least 5 times that of the core, more preferably at least 6 times that of the core, and most preferably at least 9 times that of the core.

Suitable high density fillers may have specific gravity in the range from about 2.0 g/cc to about 19.0 g/cc, and include, for example, metal powders, metal alloy powders, metal oxides, metal searates, particulates, carbonaceous materials, or blends thereof Suitable metal (or metal alloy) powders include, but are not limited to, bismuth powder, boron powder, brass powder, bronze powder, cobalt powder, copper powder, inconel metal powder, iron metal powder, molybdenum powder, nickel powder, stainless steel powder, titanium metal powder, zirconium oxide powder, aluminum flakes, tungsten metal powder, beryllium metal powder, zinc metal powder, or tin metal powder. Suitable metal oxides include, but are not limited to, zinc oxide, iron oxide, aluminum oxide, titanium dioxide, magnesium oxide, zirconium oxide, and tungsten trioxide. Suitable carbonaceous materials include, but are not limited to, graphite and carbon black. Examples of other useful fillers include, but are not limited to, graphite fibers, precipitated hydrated silica, clay, talc, glass fibers, aramid fibers, mica, calcium metasilicate, barium sulfate, zinc sulfide, silicates, diatomaceous earth, calcium carbonate, magnesium carbonate, regrind (recycled cured center material typically mixed and ground to 30 mesh particle size), manganese powder, and magnesium powder. A more preferred high density filler is tungsten, tungsten oxide, or tungsten metal powder, due to its particularly high specific gravity of about 19.0 g/cc.

Suitable low density fillers may include hollow spheres or microspheres that are incorporated into the core material, preferably fully-neutralized ionomer, such that the resultant composition has a specific gravity of less than 0.9 g/cc, more preferably less than 0.8 g/cc. Low density fillers may also include air pockets that are present in foamed polymers, such as a polyurethane foam or an integrally skinned polyurethane foam that forms a solid skin of polyurethane over a foamed substrate of the same composition. Foamed polymers also include a nucleated reaction injection molded polyurethane or polyurea, where a gas, typically nitrogen, is essentially whipped into at least one component of the polyurethane, typically, the pre-polymer, prior to component injection into a closed mold where full reaction takes place resulting in a cured polymer having a reduced specific gravity. Foamed polymers also include chemically- or physically-foamed thermoplastic or thermosetting polymers.

To craft a high moment of inertia (low spin golf ball), high density fillers may be added to outer portions of the ball, e.g., an outer core layer or, more preferably, an inner cover layer. Alternatively, low density fillers may be added to the inner portions of the ball, e.g., an inner core layer. Conversely, to craft a low moment of inertia (high spin golf ball), low density fillers may be added to the outer portions of the ball or high density fillers may be added to inner portions of the golf ball. Additionally, fillers are also used to bring the weight of golf balls to 1.62 oz, which is the upper weight limit set forth by the USGA.

One drawback of using fillers in the golf ball is that the fillers reduce the resilience and the coefficient of restitution (COR) of the golf ball, and more particularly the COR of the core or layers where the fillers are added. The COR in solid core golf balls is a function of the composition of the molded core and of the cover. As discussed above, the molded core and the cover may comprise one or more layers. The COR is related to the initial velocity of the ball. Hence, the COR of the cores and golf balls are maximized.

One suitable material for the core is rubber, such as polybutadiene, however, a preferred material for the inventive cores are highly-neutralized polymers (HNP), more preferably highly- and fully-neutralized ionomers, most preferably ionomers fully-neutralized with a combination of Mg, Na, Zn, Li, K, or Ca cations (or mixtures thereof) and one or more fatty-acid salts of oleic, stearic, or behenic acids.

The acid moieties of the HNP's, typically ethylene-based ionomers, are preferably neutralized greater than about 70%, more preferably greater than about 90%, and most preferably at least about 100%. The HNP's can be also be blended with a second polymer component, which, if containing an acid group, may be neutralized in a conventional manner, by the organic fatty acids of the present invention, or both. The second polymer component, which may be partially- or fully-neutralized, preferably comprises ionomeric copolymers and terpolymers, ionomer precursors, thermoplastics, polyamides, polycarbonates, polyesters, polyurethanes, polyureas, thermoplastic elastomers, polybutadiene rubber, balata, metallocene-catalyzed polymers (grafted and non-grafted), single-site polymers, high-crystalline acid polymers, cationic ionomers, and the like. HNP polymers typically have a material hardness of between about 20 and about 80 Shore D, and a flexural modulus of between about 3,000 psi and about 200,000 psi.

In one embodiment of the present invention the HNP's are ionomers and/or their acid precursors that are preferably neutralized, either fully or partially, with organic acid copolymers or the salts thereof. The acid copolymers are preferably α-olefin, such as ethylene, $C_{3-8}$ α,β-ethylenically unsaturated carboxylic acid, such as acrylic and methacrylic acid, copolymers. They may optionally contain a softening monomer, such as alkyl acrylate and alkyl methacrylate, wherein the alkyl groups have from 1 to 8 carbon atoms.

The acid copolymers can be described as E/X/Y copolymers where E is ethylene, X is an α,β-ethylenically unsaturated carboxylic acid, and Y is a softening comonomer. In a preferred embodiment, X is acrylic or methacrylic acid and Y is a $C_{1-8}$ alkyl acrylate or methacrylate ester. X is preferably present in an amount from about 1 to about 35 weight percent of the polymer, more preferably from about 5 to about 30 weight percent of the polymer, and most preferably from about 10 to about 20 weight percent of the polymer. Y is preferably present in an amount from about 0 to about 50 weight percent of the polymer, more preferably from about 5 to about 25 weight percent of the polymer, and most preferably from about 10 to about 20 weight percent of the polymer.

Specific acid-containing ethylene copolymers include, but are not limited to, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include, ethylene/methacrylic acid/n-butyl acrylate, ethylene/acrylic acid/n-butyl acrylate, ethylene/methacrylic acid/methyl acrylate, ethylene/acrylic acid/ethyl acrylate, ethylene/methacrylic acid/ethyl acrylate, and ethylene/acrylic acid/methyl acrylate copolymers. The most preferred acid-containing ethylene copolymers are, ethylene/(meth)acrylic acid/n-butyl, acrylate, ethylene/(meth)acrylic acid/ethyl acrylate, and ethylene/(meth) acrylic acid/methyl acrylate copolymers.

Ionomers are typically neutralized with a metal cation, such as Li, Na, Mg, or Zn. It has been found that by adding sufficient organic acid or salt of organic acid, along with a suitable base, to the acid copolymer or ionomer, the ionomer can be neutralized without losing processability to a level much greater than for a metal cation alone. Preferably, the acid moieties are neutralized greater than about 80%, preferably from 90-100%, most preferably 100% without losing processability. This accomplished by melt-blending an ethylene α,β-ethylenically unsaturated carboxylic acid copolymer, for example, with an organic acid or a salt of organic acid, and adding a sufficient amount of a cation source to increase the level of neutralization of all the acid moieties (including those in the acid copolymer and in the organic acid) to greater than 90%, (preferably greater than 100%).

The organic acids of the present invention are aliphatic, mono- or multi-functional (saturated, unsaturated, or multi-unsaturated) organic acids. Salts of these organic acids may also be employed. The salts of organic acids of the present invention include the salts of barium, lithium, sodium, zinc, bismuth, chromium, cobalt, copper, potassium, strontium, titanium, tungsten, magnesium, cesium, iron, nickel, silver, aluminum, tin, or calcium, salts of fatty acids, particularly stearic, behenic, erucic, oleic, linoelic or dimerized derivatives thereof. It is preferred that the organic acids and salts of the present invention be relatively non-migratory (they do not bloom to the surface of the polymer under ambient temperatures) and non-volatile (they do not volatilize at temperatures required for melt-blending).

The ionomers of the invention may also be partially-neutralized with metal cations. The acid moiety in the acid copolymer is neutralized about 1 to about 100%, preferably at least about 40 to about 100%, and more preferably at least about 90 to about 100%, to form an ionomer by a cation such as lithium, sodium, potassium, magnesium, calcium, barium, lead, tin, zinc, aluminum, or a mixture thereof.

The acid copolymers of the present invention are prepared from 'direct' acid copolymers, copolymers polymerized by adding all monomers simultaneously, or by grafting of at least one acid-containing monomer onto an existing polymer. Other suitable highly-neutralized acid polymer compositions are disclosed in U.S. Patent Publication Nos. 2003/0114565 and 2005/0267240, and in U.S. patent application Ser. No. 11/270,066, which are incorporated herein, in their entirety, by reference.

When fillers, such as zinc oxide (when not used in quantity sufficient to effect a full cure of a zinc diacrylate/peroxide polybutadiene rubber system as described below) are mixed with rubber materials, the resilience of the rubber can decrease. This change in resilience can be measured by measuring the core compression. Compression is measured by applying a spring-loaded force to the golf ball center, golf ball core or the golf ball to be examined, with a manual instrument (an "Atti gauge") manufactured by the Atti Engineering Company of Union City, N.J. This machine, equipped with a Federal Dial Gauge, Model D81-C, employs a calibrated spring under a known load. The sphere to be tested is forced a distance of 0.2 inches against this spring. If the spring, in turn, compresses 0.2 inches, the compression is rated at 100; if the spring compresses 0.1 inches, the compression value is rated as 0. Thus more compressible, softer materials will have lower Atti gauge values than harder, less compressible materials. Compression measured with this instrument is sometimes referred to as PGA compression.

To maximize the resilience and COR of the ball the core, in accordance with one embodiment of the present invention, is substantially free of fillers. In other words, the core has the highest possible content of polymeric core materials, more preferably the highest content of fully-neutralized ionomer, relative to the amount of filler. As used herein, the term "substantially free of fillers" means that the filler content is no more than about 5 parts per hundred parts HNP.

The upper limit of filler content accounts for the impurities inherent in the materials that make up the core composition and has no other function other than weight contribution. For example, for a core composition that contains zinc acrylate or zinc diacrylate, a small amount of zinc oxide is added to the composition as an activator. Zinc oxide also reacts with and neutralizes any free acrylic acid that may be present in the zinc acrylate or zinc diacrylate to form zinc acrylate or zinc diacrylate. The zinc acrylate or zinc diacrylate is believed to become a part of the polymeric structure after the cross-linking process. The un-reacted zinc oxide remains in the core and acts as a high-density filler. Hence, cores that have less than 5 phr filler to a 100 phr of HNP ionomer (or rubber, if a rubber-based core material is used) are within the scope of the present invention. More preferably, the cores have less than 3 phr of filler to a 100 phr HNP ionomer.

Minimizing the thickness of the cover layers can also optimize the volume of the core. Preferably, the thickness of cover layers ranges from about 0.005 inches to about 0.040 inches, and more preferably ranges from about 0.010 inches to about 0.030 inches. In a preferred embodiment, the dense, inner cover layer has a thickness of 0.005 inches to 0.015 inches, preferably 0.015 inches. Preferred compositions and properties of the cover layers in accordance to the present invention are described below. Relatively large cores with diameters in the range of 1.54 to 1.64 inches in diameter can be realized with these thin cover layers. However, cores with the diameter in the range of 1.58 inches to 1.62 inches are preferred. It has been discovered that the COR varies with the rate of deformation of the golf ball. More specifically, the COR is higher at higher rates of deformation and higher rate of recovery than at lower rates.

The compositions of outer core layer, if present, are preferably formed from the HNP materials described above, or a blend of a variety of HNP materials. In another embodiment, the outer core is made from a polybutadiene rubber that has a mid Mooney viscosity range greater than about 40, more preferably in the range from about 40 to about 80 and more preferably in the range from about 40 to about 60 Mooney. Polybutadiene rubber with higher Mooney viscosity may also be used, so long as the viscosity of the polybutadiene does not reach a level where the high viscosity polybutadiene clogs or otherwise adversely interferes with the manufacturing machinery. It is contemplated that polybutadiene with viscosity less than 65 Mooney can be used with the present invention. A "Mooney" unit is a unit used to measure the plasticity of raw or unvulcanized rubber. The plasticity in a "Mooney" unit is equal to the torque, measured on an arbitrary scale, on a disk in a vessel that contains rubber at a temperature of 100° C. and rotates at two revolutions per minute. The measurement of Mooney viscosity is defined according to ASTM D-1646.

Golf ball cores made with mid to high Mooney viscosity polybutadiene material exhibit increased resiliency, hence distance, without increasing the hardness of the ball. Such cores are soft, i.e., compression less than about 60 and more specifically in the range of about 50-55, and when these soft cores are incorporated into golf balls such cores generate very low spin and long distance when struck by a driver. Cores with compression in the range of from about 30 about 50 are also within the range of this preferred embodiment.

Commercial sources of suitable mid to high Mooney polybutadiene include Bayer AG. CB23, which has a Mooney viscosity of about 51 and is a highly linear polybutadiene, is a preferred polybutadiene. If desired, the polybutadiene can also be mixed with other elastomers known in the art, such as natural rubber, styrene butadiene, and/or isoprene in order to further modify the properties of the core. When a mixture of elastomers is used, the amounts of other constituents in the core composition are typically based on 100 parts by weight of the total elastomer mixture.

Other suitable core materials including thermoset plastics, such as natural rubber, other grades of polybutadiene, polyisoprene, styrene-butadiene or styrene-propylene-diene rubber, and thermoplastics such as ionomer resins, polyamides, polyesters, or a thermoplastic elastomer.

Suitable thermoplastic elastomers include PEBAX®, which is believed to comprise polyether amide copolymers, HYTREL®, which is believed to comprise polyether ester copolymers, thermoplastic urethane, and KRATON®, which is believed to comprise styrenic block copolymers elastomers. These products are commercially available from Elf-Atochem, E.I. Du Pont de Nemours & Company, various manufacturers, and Shell Chemical Company, respectively. The core materials can also be formed from a metal salt of a fatty acid, any partially or fully neutralized ionomer, a metallocene or other catalyzed polymer and a castable material. Suitable castable materials include those comprising a urethane, polyurea, epoxy, silicone, IPN's, etc. Golf ball cores made with these core materials has an Atti compression of preferably less than 90, more preferably less than 85, and most preferably less than 70. In one embodiment, the core has an Atti compression that ranges from 75 to 85.

Additionally, other suitable core materials (and cover materials) are disclosed in U.S. U.S. Pat. No. 5,919,100 and international publications WO 00/23519 and WO 01/29129. These disclosures are incorporated by reference herein in their entireties. One particularly suitable material disclosed in WO/29129 is a melt processible composition comprising a highly-neutralized ethylene copolymer and one or more aliphatic, mono-functional organic acids having fewer than 36 carbon atoms of salts thereof, wherein greater than 90% of all the acid of the ethylene copolymer is neutralized.

In accordance to another aspect of the invention, the addition of sulfur compound to the core further increases the resiliency and the coefficient of restitution of the ball. Preferred sulfur compounds include, but are not limited to, pentachlorothiophenol (PCTP) and a salt of PCTP. A preferred salt of PCTP is ZnPCTP. The utilization of PCTP and ZnPCTP in golf ball cores to produce soft and fast cores is disclosed in U.S. Pat. No. 6,635,716, which is incorporated by reference herein, in its entirety. A suitable PCTP is sold by the Structol Company under the tradename A95. ZnPCTP is commercially available from EchinaChem.

Metal salt diacrylates, dimethacrylates, and monomethacrylates suitable for use in this invention include those wherein the metal is magnesium, calcium, zinc, aluminum, sodium, Lithium or nickel. Zinc diacrylate (ZDA) is preferred, but the present invention is not limited thereto. ZDA provides golf balls with a high initial velocity. The ZDA can be of various grades of purity. For the purposes of this invention, the lower the quantity of zinc stearate present in the ZDA the higher the ZDA purity. ZDA containing less than about 10% zinc stearate is preferable. More preferable is ZDA containing about 4-8% zinc stearate. Suitable, commercially available zinc diacrylates include those from Sartomer Co. The preferred concentrations of ZDA that can be used are about 25 pph to about 35 pph based upon 100 pph of polybutadiene or alternately, polybutadiene with a mixture of other elastomers that equal 100 pph. Advantageously, the PCTP organic sulfur reacts with the ZDA used in the core to further increase the initial velocity of golf balls.

Free radical initiators are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di(t-butylperoxy)3,3,5-trimethyl cyclohexane, a—a bis(t-butylperoxy) diisopropylbenzene, 2,5-dimethyl-2,5di(t-butylperoxy)hexane, or di-t-butyl peroxide, and mixtures thereof. Other useful initiators would be readily apparent to one of ordinary skill in the art without any need for experimentation. The initiator(s) at about 70% to about 100% activity are preferably added in an amount ranging between about 0.05 pph and about 2.5 pph based upon 100 parts of butadiene, or butadiene mixed with one or more other elastomers. More preferably, the amount of initiator added ranges between about 0.15 pph and about 2 pph and most preferably between about 0.25 pph and about 1.5 pph. Suitable commercially-available dicumyl peroxides include PERKADOX BC, which is a 90% active dicumyl peroxide, and DCP 70, which is a 70% active dicumyl peroxide.

As discussed above, when ZDA or another metal salt of diacrylates, dimethacrylates, and monomethacrylates are used in the core, about 5 phr of zinc oxide or less (or a smaller amount of calcium oxide and higher amount of peroxide) is preferably added to the core composition to react and neutralize any acrylic acid that may be present.

Antioxidants may also be included. Antioxidants are compounds, which prevent the breakdown of the elastomer. Antioxidants useful in the present invention include, but are not limited to, quinoline type antioxidants, amine type antioxidants, and phenolic type antioxidants.

Other ingredients such as accelerators, e.g., tetra methylthiuram, processing aids, processing oils, dyes and pigments, as well as other additives well known to the skilled artisan may also be used in the present invention in amounts sufficient to achieve the purpose for which they are typically used.

In a particularly preferred embodiment of the invention, the golf ball comprises a core, a thin, dense inner cover layer, and an outer over layer. In this embodiment, core and the thin, dense inner cover layer are both formed from the HNP material, but the inner cover layer has a specific gravity that is greater than that of the core material, preferably at least 5 times greater, more preferably at least 6 times greater, most preferably at least 9 times greater. Typical preferred specific gravities for the inner cover layer are 2.5 g/cc, preferably 4.0 g/cc, more preferably 6.0 g/cc, and most preferably 8.0 g/cc.

As discussed above, the radial distance (the "centroid radius") from the center of the ball or from the outer cover, where moment of inertia switches from being increased and to being decreased as a result of the redistribution of weight or mass density, is an important factor in golf ball design. When more of the mass of the ball is reallocated from the center to the centroid radius, the moment of inertia is decreased, thereby producing a high spin ball. When more of the mass of the ball is reallocated between the centroid radius and the outer cover, the moment of inertia is increased thereby producing a low spin ball. The centroid radius can be determined by the following steps:

(a) Setting Ro to half of the 1.68-inch diameter for an average size ball, where $R_o$ is the outer radius of the ball.

(b) Setting the weight of the ball to the USGA limit of 1.62 oz.

(c) Determining the moment of inertia of a ball with evenly distributed density prior to any weight distribution. The moment of inertia is represented by $(2/5)(M_t)(R_o^2)$, where Mt is the total mass or weight of the ball. For the purpose of this invention, mass and weight can be used interchangeably. The formula for the moment of inertia for a sphere through any diameter is given in the CRC Standard Mathematical Tables, $24^{th}$ Edition, 1976 ("CRC"). The moment of inertia of such a ball is 0.4572 oz-in$^2$, the baseline moment of inertia value.

(d) Taking a predetermined amount of weight uniformly from the ball and reallocating this predetermined weight in the form of a thin shell to a location near the center of the ball and calculating the new moment of inertia of the weight redistributed ball (this moment of inertia is the sum of the inertia of the ball with the reduced weight plus the moment of inertia contributed by the thin shell. This new moment of inertia is expressed as $(2/5)(M_r)(R_o^2)+(2/3)(M_s)(R_s^2)$, where Mr is the reduced weight of the ball; Ms is the weight of the thin shell; and $R_s$ is the radius of the thin shell measured from the center of the ball. Also, $M_t=M_r+M_s$. The formula of the moment of inertia from a thin shell is also given in the CRC).

(e) Comparing the new moment of inertia determined in step (d) to the baseline inertia value determined in step (c) to determine whether the moment of inertia has increased or decreased due to the reallocation of weight, i.e., subtracting the baseline inertia from the new inertia.

(f) Repeating steps (d) and (e) with the same predetermined weight incrementally moving away from the center of the ball until the predetermined weight reaches the outer surface of the ball.

(g) Determining the centroid radius as the radial location where the moment of inertia changes from increasing to decreasing.

(h) Repeating steps (d), (e), (f), and (g) with different predetermined weights and confirming that the centroid radius is the same for each predetermined weight.

Representative calculations are fully disclosed in the two parent applications, whose disclosures have been incorporated by reference. The results show that for each predetermined weight, the centroid radius is located at the same radial distance, i.e., at approximately 0.65 inches radially outward from the center of a ball weighing 1.62 oz and with a diameter of 1.68 inches, or 0.19 inches radially inward from the surface of the ball.

Another advantageous result readily derived from the above procedure is that at a radial distance of less than about 0.25 inches, or more significantly less than about 0.20 inches, from the center of the ball the rate of the reduction in moment of inertia is considerably less than the rate of the reduction in moment of inertia from a radial distance from 0.25 inches to 0.65 inches. In other words, substantially all of the reduction in moment of inertia can be achieved by redistributing the weight of the ball to within an innermost core of about 0.40 inches to 0.50 inches in diameter.

In a dual core embodiment, where the core is formed from the combination of a center and an outer core layer, the outer layer preferably contains substantially no fillers. Preferably, the thickness of the outer core is between about 0.55 inches and 0.62 inches. Alternatively, when an outer thin dense layer is used as described herein, outer core may be thin, e.g., about 0.05 inches thick, or it may be combined with inner core having substantially no filler. The preferred specific gravity of the outer core layer is between about 1.0 g/cc and about 1.1 g/cc. A specific gravity between about 0.5 g/cc and about 1.05 g/cc, and more preferably between about 0.8 g/cc and about 0.96 g/cc is also suitable for the outer core.

In a low moment of inertia embodiment (high spin ball), the core (or center in a dual core construction) preferably has a high specific gravity in the range of greater than about 5.0 g/cc, more preferably greater than about 6.5 g/cc. As stated above, the preferred diameter of inner core is about 0.4 to about 0.5 inches. Diameters of less than about 0.75 inches or less than about 0.4 inches are also suitable for this embodiment.

In another embodiment of the invention, core or the thin dense inner cover layer comprise high density tungsten powder fillers having a specific gravity of higher than 19 g/cc incorporated into the polymeric matrix the core or layers are formed from. Preferably the polymer matrix is polyurethane, more preferably the polymer matrix is a fully-neutralized ionomer. Other high density metal powders, such as lead, are suitable.

Alternatively, the core may comprise carbon, stainless, or chrome steel spheres that are commercially available as ball bearings in sizes from 1 mm to 20 mm. Preferred sizes are ¼ inches, ⅜ inches, 5/16 inches, 7/16 inches, ½ inches, ¾ inches or 11/16 inches in diameter. Ball bearings made out of mild steel have a specific gravity of about 7.80. Also, stainless steels such as type 1225 has a specific gravity of about 6.5, and type 1650 has a specific gravity of about 7.5.

For a high moment of inertia embodiment (low spin ball), the center or core preferably have a low specific gravity. As stated above, the core preferably comprises a polymer containing a density-reducing filler, or otherwise has its specific gravity reduced, e.g., by foaming the polymer. The most preferred polymer for the core is a fully-neutralized ionomer or a blend thereof The effective specific gravity for this low specific gravity core (or additional outer core layer) is preferably less than about 0.9 and more preferably less than about 0.8. Alternatively, core may contain a center that is filled with air (specific gravity of about 0.0013) or alcohol (specific gravity of about 0.79).

Preferably the thickness of the outer cover layer ranges from about 0.010 inches to about 0.040 inches, and more preferably ranges from about 0.010 inches to about 0.030 inches. A thinner cover layer allows increased volume for more resilient polymeric core materials to be included in the core, core layers, or thin, dense layer.

The outer cover layer is preferably formed from a relatively soft thermoset material in order to replicate the soft feel and high spin play characteristics of a balata ball when the balls of the present invention are used for pitch and other "short game" shots. In particular, the outer cover layer should have a Shore D hardness of from less than about 65 or about 30 to about 60, preferably about 35 to about 50 and most preferably about 40 to about 45. Hardness is preferably measured pursuant to ASTM D-2240 in either button or slab form. Additionally, the materials of the outer cover layer must have a degree of abrasion resistance in order to be suitable for use as a golf ball cover.

The outer cover layer of the present invention can comprise any suitable thermoset material, which is formed from a castable reactive liquid material. The preferred materials for the outer cover layer include, but are not limited to, thermoset urethanes and polyurethanes, thermoset urethane ionomers and thermoset urethane epoxies. Examples of suitable polyurethane ionomers are disclosed in U.S. Pat. No. 5,692,974, the disclosure of which is hereby incorporated by reference herein in its entirety in the present application.

The cover layer, which can be formed of any of the above listed materials, preferably includes polymers, such as ethylene, propylene, butene-1 or hexane-1 based homopolymers or copolymers including functional monomers, such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(vinyl alcohol), poly(tetrafluoroethylene) and their copolymers including functional comonomers, and blends thereof Suitable cover compositions also include a polyether or polyester thermoplastic urethane, a thermoset polyurethane, a low modulus ionomer, such as acid-containing ethylene copolymer ionomers, including E/X/Y terpolymers where E is ethylene, X is an acrylate or methacrylate-based softening comonomer present in about 0 to 50 weight percent and Y is acrylic or methacrylic acid present in about 5 to 35 weight percent. More preferably, in a low spin rate embodiment designed for maximum distance, the acrylic or methacrylic acid is present in about 16 to 35 weight percent, making the ionomer a high modulus ionomer. In a higher spin embodiment, the inner cover layer includes an ionomer where an acid is present in about 10 to 15 weight percent and includes a softening comonomer. Additionally, high-density polyethylene ("HDPE"), low-density polyethylene ("LDPE"), LLDPE, and homo- and co-polymers of polyolefin are suitable for a variety of golf ball layers.

In one embodiment, the outer cover preferably includes a polyurethane or polyurea composition comprising the reaction product of at least one polyisocyanate, polyol, and at least one curing agent. Any polyisocyanate available to one of ordinary skill in the art is suitable for use according to the invention. Exemplary polyisocyanates include, but are not limited to, 4,4'-diphenylmethane diisocyanate ("MDI"); polymeric MDI; carbodiimide-modified liquid MDI; 4,4'-dicyclohexylmethane diisocyanate; p-phenylene diisocyanate ("PPDI"); m-phenylene diisocyanate; toluene diisocyanate ("TDI"); 3,3'-dimethyl-4,4'-biphenylene diisocyanate; isophoronediisocyanate; hexamethylene diisocyanate ("HDI"); naphthalene diisocyanate; xylene diisocyanate; p-tetramethylxylene diisocyanate; m-tetramethylxylene diisocyanate; ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate; tetracene diisocyanate; napthalene diisocyanate; anthracene diisocyanate; isocyanurate of toluene diisocyanate; uretdione of hexamethylene diisocyanate; and mixtures thereof. Polyisocyanates are known to those of ordinary skill in the art as having more than one isocyanate group, e.g., di-isocyanate, tri-isocyanate, and tetra-isocyanate. Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups, typically less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate should have less than about 14% unreacted NCO groups. Preferably, the at least one polyisocyanate has no greater than about 7.5% NCO, and more preferably, less than about 7.0%.

Any polyol available to one of ordinary skill in the art is suitable for use according to the invention. Exemplary polyols include, but are not limited to, polyether polyols, hydroxy-terminated polybutadiene (including partially/fully hydrogenated derivatives), polyester polyols, polycaprolactone polyols, and polycarbonate polyols. In one preferred embodiment, the polyol includes polyether polyol. Examples include, but are not limited to, polytetramethylene ether glycol ("PTMEG"), polyethylene propylene glycol, polyoxypropylene glycol, and mixtures thereof. The hydrocarbon chain can have saturated or unsaturated bonds and substituted or unsubstituted aromatic and cyclic groups. Preferably, the polyol of the present invention includes PTMEG.

In another embodiment, polyester polyols are included in the polyurethane material of the invention. Suitable polyester polyols include, but are not limited to, polyethylene adipate glycol; polybutylene adipate glycol; polyethylene propylene adipate glycol; o-phthalate-1,6-hexanediol; poly (hexamethylene adipate) glycol; and mixtures thereof. The hydrocarbon chain can have saturated or unsaturated bonds, or substituted or unsubstituted aromatic and cyclic groups.

In another embodiment, polycaprolactone polyols are included in the materials of the invention. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

In yet another embodiment, the polycarbonate polyols are included in the polyurethane material of the invention. Suitable polycarbonates include, but are not limited to, polyphthalate carbonate and poly(hexamethylene carbonate) glycol. The hydrocarbon chain can have saturated or unsaturated bonds, or substituted or unsubstituted aromatic and cyclic groups. In one embodiment, the molecular weight of the polyol is from about 200 to about 4000.

Polyamine curatives are also suitable for use in polyurethane compositions and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-methylene-bis-(2,3-dichloroaniline); 4,4'-diamino-3,3'-diethyl-5,5'-dimethyl diphenylmethane; 2,2',3,3'-tetrachloro diamino diphenylmethane; trimethylene glycol di-p-aminobenzoate; and mixtures thereof. Preferably, the curing agent of the present invention includes 3,5-dimethylthio-2,4-toluenediamine and isomers thereof, such as ETHACURE 300, commercially available from Albermarle Corporation of Baton Rouge, La. Suitable polyamine curatives, which include both primary and secondary amines, preferably have molecular weights ranging from about 64 to about 2000.

At least one of a diol, triol, tetraol, or hydroxy-terminated curatives may be added to the aforementioned polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(β-hydroxyethyl)ether; hydroquinone-di-(β-hydroxyethyl)ether; and mixtures thereof. Preferred hydroxy-terminated curatives include 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol, and mixtures thereof. Preferably, the hydroxy-terminated curatives have molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

In a preferred embodiment of the present invention, saturated polyurethanes are used to form cover layers, preferably the outer cover layer, and may be selected from among both castable thermoset and thermoplastic polyurethanes.

In this embodiment, the saturated polyurethanes of the present invention are substantially free of aromatic groups or moieties. Saturated polyurethanes suitable for use in the invention are a product of a reaction between at least one polyurethane prepolymer and at least one saturated curing agent. The polyurethane prepolymer is a product formed by a reaction between at least one saturated polyol and at least one saturated diisocyanate. As is well known in the art, a catalyst may be employed to promote the reaction between the curing agent and the isocyanate and polyol.

The compositions of the invention may also be polyurea-based. Polyureas are distinctly different from polyurethane compositions, but also result in desirable aerodynamic and aesthetic characteristics when used in golf ball components. The polyurea-based compositions may be saturated in nature to aid in resistance to color change upon exposure to UV light.

Without being bound to any particular theory, it is believed that substitution of the long chain polyol segment in the polyurethane prepolymer with a long chain polyamine oligomer soft segment to form a polyurea prepolymer, improves shear, cut, and resiliency, as well as adhesion to other components. Thus, the polyurea compositions of this invention may be formed from the reaction product of an isocyanate and polyamine prepolymer crosslinked with a curing agent. For example, polyurea-based compositions of the invention may be prepared from at least one isocyanate, at least one polyether amine, and at least one diol curing agent or at least one diamine curing agent.

Any polyamine available to one of ordinary skill in the art is suitable for use in the polyurea prepolymer. Polyether amines are particularly suitable for use in the prepolymer. As used herein, "polyether amines" refer to at least polyoxyalkyleneamines containing primary amino groups attached to the terminus of a polyether backbone. Due to the rapid reaction of isocyanate and amine, and the insolubility of many urea products, however, the selection of diamines and polyether amines is limited to those allowing the successful formation of the polyurea prepolymers. In one embodiment, the polyether backbone is based on tetramethylene, propylene, ethylene, trimethylolpropane, glycerin, and mixtures thereof.

Suitable polyether amines include, but are not limited to, methyldiethanolamine; polyoxyalkylenediamines such as, polytetramethylene ether diamines, polyoxypropylenetriamine, and polyoxypropylene diamines; poly(ethylene oxide capped oxypropylene) ether diamines; propylene oxide-based triamines; triethyleneglycoldiamines; trimethylolpropane-based triamines; glycerin-based triamines; and mixtures thereof In one embodiment, the polyether amine used to form the prepolymer is JEFFAMINE® D2000, manufactured by Huntsman Chemical Co. of Austin, Tex.

The molecular weight of the polyether amine for use in the polyurea prepolymer may range from about 100 to about 5000. In one embodiment, the polyether amine molecular weight is about 200 or greater, preferably about 230 or greater. In another embodiment, the molecular weight of the polyether amine is about 4000 or less. In yet another embodiment, the molecular weight of the polyether amine is about 600 or greater. In still another embodiment, the molecular weight of the polyether amine is about 3000 or less. In yet another embodiment, the molecular weight of the polyether amine is between about 1000 and about 3000, and more preferably is between about 1500 to about 2500. Because lower molecular weight polyether amines may be prone to forming solid polyureas, a higher molecular weight oligomer, such as Jeffamine D2000, is preferred.

In one embodiment, the polyether amine has the generic structure:

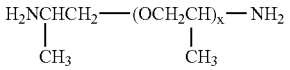

wherein the repeating unit x has a value ranging from about 1 to about 70. Even more preferably, the repeating unit may be from about 5 to about 50, and even more preferably is from about 12 to about 35.

In another embodiment, the polyether amine has the generic structure:

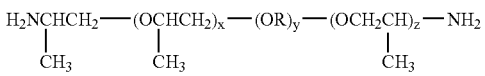

wherein the repeating units x and z have combined values from about 3.6 to about 8 and the repeating unit y has a value ranging from about 9 to about 50, and wherein R is $—(CH_2)_a—$, where "a" may be a repeating unit ranging from about 1 to about 10.

In yet another embodiment, the polyether amine has the generic structure:

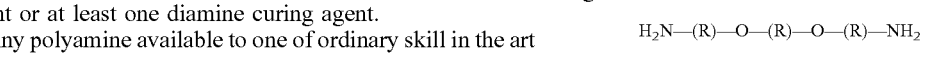

wherein R is $—(CH_2)_a—$, and "a" may be a repeating unit ranging from about 1 to about 10.

As briefly discussed above, some amines may be unsuitable for reaction with the isocyanate because of the rapid reaction between the two components. In particular, shorter chain amines are fast reacting. In one embodiment, however, a hindered secondary diamine may be suitable for use in the prepolymer. Without being bound to any particular theory, it is believed that an amine with a high level of stearic hindrance, e.g., a tertiary butyl group on the nitrogen atom, has a slower reaction rate than an amine with no hindrance or a low level of hindrance. For example, 4,4'-bis-(sec-butylamino)-dicyclohexylmethane (CLEARLINK® 1000) may be suitable for use in combination with an isocyanate to form the polyurea prepolymer.

Any isocyanate available to one of ordinary skill in the art is suitable for use in the polyurea prepolymer. Isocyanates for use with the present invention include aliphatic, cycloaliphatic, araliphatic, aromatic, any derivatives thereof, and combinations of these compounds having two or more isocyanate (NCO) groups per molecule. The isocyanates may be organic polyisocyanate-terminated prepolymers. The isocyanate-containing reactable component may also include any isocyanate-functional monomer, dimer, trimer, or multimeric adduct thereof, prepolymer, quasi-prepolymer, or mixtures thereof. Isocyanate-functional compounds may include monoisocyanates or polyisocyanates that include any isocyanate functionality of two or more.

Suitable isocyanate-containing components include diisocyanates having the generic structure: O═C═N—R—N═C═O, where R is preferably a cyclic, aromatic, or linear or branched hydrocarbon moiety containing from about 1 to about 20 carbon atoms. The diisocyanate may also contain one or more cyclic groups or one or more phenyl groups. When multiple cyclic or aromatic groups are present, linear and/or branched hydrocarbons containing from about 1 to about 10 carbon atoms can be present as spacers between the cyclic or aromatic groups. In some cases, the cyclic or aromatic group(s) may be substituted at the 2-, 3-, and/or 4-positions, or at the ortho-, meta-, and/or para-positions, respectively. Substituted groups may include, but are not limited to, halogens, primary, secondary, or tertiary hydrocarbon groups, or a mixture thereof.

Examples of diisocyanates that can be used with the present invention include, but are not limited to, substituted and isomeric mixtures including 2,2'-, 2,4'-, and 4,4'-diphenylmethane diisocyanate; 3,3'-dimethyl-4,4'-biphenylene diisocyanate; toluene diisocyanate; polymeric MDI; carbodiimide-modified liquid 4,4'-diphenylmethane diisocyanate; p-phenylene diisocyanate; m-phenylene diisocyanate; triphenyl methane-4,4'- and triphenyl methane-4,4'-triisocyanate; naphthylene-1,5-diisocyanate; 2,4'-, 4,4'-, and 2,2-biphenyl diisocyanate; polyphenyl polymethylene polyisocyanate; mixtures of MDI and PMDI; mixtures of PMDI and TDI; ethylene diisocyanate; propylene-1,2-diisocyanate; tetramethylene-1,2-diisocyanate; tetramethylene-1,3-diisocyanate; tetramethylene-1,4-diisocyanate; 1,6-hexamethylene-diisocyanate; octamethylene diisocyanate; decamethylene diisocyanate; 2,2,4-trimethylhexamethylene diisocyanate; 2,4,4-trimethylhexamethylene diisocyanate; dodecane-1,12-diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate; 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis (isocyanatomethyl)-cyclohexane diisocyanate; 4,4'-bis (isocyanatomethyl)dicyclohexane; 2,4'-bis (isocyanatomethyl)dicyclohexane; isophorone diisocyanate; triisocyanate of HDI; triisocyanate of 2,2,4-trimethyl-1,6-hexane diisocyanate; 4,4'-dicyclohexylmethane diisocyanate; 2,4-hexahydrotoluene diisocyanate; 2,6-hexahydrotoluene diisocyanate; 1,2-, 1,3-, and 1,4-phenylene diisocyanate; aromatic aliphatic isocyanate, such as 1,2-, 1,3-, and 1,4-xylene diisocyanate; m-tetramethylxylene diisocyanate; p-tetramethylxylene diisocyanate; trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, isocyanurate of isophorone diisocyanate, and mixtures thereof; dimerized uredione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof.

The number of unreacted NCO groups in the polyurea prepolymer of isocyanate and polyether amine may be varied to control such factors as the speed of the reaction, the resultant hardness of the composition, and the like. For instance, the number of unreacted NCO groups in the polyurea prepolymer of isocyanate and polyether amine may be less than about 14 percent. In one embodiment, the polyurea prepolymer has from about 5 percent to about 11 percent unreacted NCO groups, and even more preferably has from about 6 to about 9.5 percent unreacted NCO groups. In one embodiment, the percentage of unreacted NCO groups is about 3 percent to about 9 percent. Alternatively, the percentage of unreacted NCO groups in the polyurea prepolymer may be about 7.5 percent or less, and more preferably, about 7 percent or less. In another embodiment, the unreacted NCO content is from about 2.5 percent to about 7.5 percent, and more preferably from about 4 percent to about 6.5 percent.

When formed, polyurea prepolymers may contain about 10 percent to about 20 percent by weight of the prepolymer of free isocyanate monomer. Thus, in one embodiment, the polyurea prepolymer may be stripped of the free isocyanate monomer. For example, after stripping, the prepolymer may contain about 1 percent or less free isocyanate monomer. In another embodiment, the prepolymer contains about 0.5 percent by weight or less of free isocyanate monomer.

The polyether amine may be blended with additional polyols to formulate copolymers that are reacted with excess isocyanate to form the polyurea prepolymer. In one embodiment, less than about 30 percent polyol by weight of the copolymer is blended with the saturated polyether amine. In another embodiment, less than about 20 percent polyol by weight of the copolymer, preferably less than about 15 percent by weight of the copolymer, is blended with the polyether amine. The polyols listed above with respect to the polyurethane prepolymer, e.g., polyether polyols, polycaprolactone polyols, polyester polyols, polycarbonate polyols, hydrocarbon polyols, other polyols, and mixtures thereof, are also suitable for blending with the polyether amine. The molecular weight of these polymers may be from about 200 to about 4000, but also may be from about 1000 to about 3000, and more preferably are from about 1500 to about 2500.

The polyurea composition can be formed by crosslinking the polyurea prepolymer with a single curing agent or a blend of curing agents. The curing agent of the invention is preferably an amine-terminated curing agent, more preferably a secondary diamine curing agent so that the composition contains only urea linkages. In one embodiment, the amine-terminated curing agent may have a molecular weight of about 64 or greater. In another embodiment, the molecular weight of the amine-curing agent is about 2000 or less. As discussed above, certain amine-terminated curing agents may be modified with a compatible amine-terminated freezing point depressing agent or mixture of compatible freezing point depressing agents.

Suitable amine-terminated curing agents include, but are not limited to, ethylene diamine; hexamethylene diamine; 1-methyl-2,6-cyclohexyl diamine; tetrahydroxypropylene ethylene diamine; 2,2,4- and 2,4,4-trimethyl-1,6-hexanediamine; 4,4'-bis-(sec-butylamino)-dicyclohexylmethane; 1,4-bis-(sec-butylamino)-cyclohexane; 1,2-bis-(sec-butylamino)-cyclohexane; derivatives of 4,4'-bis-(sec-butylamino)-dicyclohexylmethane; 4,4'-dicyclohexylmethane diamine; 1,4-cyclohexane-bis-(methylamine); 1,3-cyclohexane-bis-(methylamine); diethylene glycol di-(aminopropyl) ether; 2-methylpentamethylene-diamine; diaminocyclohexane; diethylene triamine; triethylene tetramine; tetraethylene pentamine; propylene diamine; 1,3-diaminopropane; dimethylamino propylamine; diethylamino propylamine; dipropylene triamine; imido-bis-propylamine; monoethanolamine, diethanolamine; triethanolamine; monoisopropanolamine, diisopropanolamine; isophoronediamine; 4,4'-methylenebis-(2-chloroaniline); 3,5;dimethylthio-2,4-toluenediamine; 3,5-dimethylthio-2,6-toluenediamine; 3,5-diethylthio-2,4-toluenediamine; 3,5;diethylthio-2,6-toluenediamine; 4,4'-bis-(sec-butylamino)-diphenylmethane and derivatives thereof; 1,4-bis-(sec-butylamino)-benzene; 1,2-bis-(sec-butylamino)-benzene; N,N'-dialkylamino-diphenylmethane; N,N,N',N'-tetrakis(2-hydroxypropyl)ethylene diamine; trimethyleneglycol-di-p-aminobenzoate; polytetramethyleneoxide-di-p-aminobenzoate; 4,4'-methylenebis-(3-chloro-2,6-diethyleneaniline); 4,4'-methylenebis-(2,6-diethylaniline); meta-phenylenediamine; paraphenylenediamine; and mixtures thereof. In one embodiment, the amine-terminated curing agent is 4,4'-bis-(sec-butylamino)-dicyclohexylmethane.

Other suitable materials useful in forming the cover and/or intermediate layer(s) of the golf balls of the invention include ionic or non-ionic polyurethanes and polyureas, epoxy resins, polyethylenes, polyamides and polyesters. For example, the cover and/or intermediate layer may be formed from a blend of at least one saturated polyurethane and thermoplastic or thermoset ionic and non-ionic urethanes and polyurethanes, cationic urethane ionomers and urethane epoxies, ionic and non-ionic polyureas and blends thereof. Examples of suitable urethane ionomers are disclosed in U.S. Pat. No. 5,692,974, the disclosure of which is hereby incorporated by reference in its entirety. Other examples of suitable polyurethanes are described in U.S. Pat. No. 5,334,673. Examples of appropriate polyureas are discussed in U.S. Pat. No. 5,484,870 and examples of suitable polyurethanes cured with epoxy group containing curing agents are disclosed in U.S. Pat. No. 5,908,358, the disclosures of which are hereby incorporated herein by reference in their entirety.

A variety of conventional components can be added to the cover compositions of the present invention. These include, but are not limited to, white pigment such as $TiO_2$, ZnO, optical brighteners, surfactants, processing aids, foaming agents, density-controlling fillers, UV stabilizers and light stabilizers. Saturated polyurethanes are resistant to discoloration. However, they are not immune to deterioration in their mechanical properties upon weathering. Addition of UV absorbers and light stabilizers therefore helps to maintain the tensile strength and elongation of the saturated polyurethane elastomers. Suitable UV absorbers and light stabilizers include TINUVIN® 328, TINUVIN® 213, TINUVIN® 765, TINUVIN® 770 and TINUVIN® 622. The preferred UV absorber is TINUVIN® 328, and the preferred light stabilizer is TINUVIN® 765. TINUVIN® products are available from Ciba-Geigy. Dyes, as well as optical brighteners and fluorescent pigments may also be included in the golf ball covers produced with polymers formed according to the present invention. Such additional ingredients may be added in any amounts that will achieve their desired purpose.

Any method known to one of ordinary skill in the art may be used to form the polyurethanes. One commonly employed method, known in the art as a one-shot method, involves concurrent mixing of the polyisocyanate, polyol, and curing agent. This method results in a mixture that is inhomogeneous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition. Other methods suitable for forming the layers of the present invention include reaction injection molding ("RIM"), liquid injection molding ("LIM"), and pre-reacting the components to form an injection moldable thermoplastic polyurethane and then injection molding, all of which are known to one of ordinary skill in the art.

Additional components which can be added to the cover compositions include UV stabilizers and other dyes, as well as optical brighteners and fluorescent pigments and dyes. Such additional ingredients may be added in any amounts that will achieve their desired purpose. It has been found by the present invention that the use of a castable, reactive material, which is applied in a fluid form, makes it possible to obtain very thin outer cover layers on golf balls. Specifically, it has been found that castable, reactive liquids, which react to form a urethane or urea (or hybrids thereof) elastomer material, provide desirable very thin outer cover layers.

The castable, reactive liquid employed to form the urethane or urea (or hybrids thereof) elastomer materials can be applied over the core using a variety of application techniques such as spraying, dipping, spin coating, or flow coating methods which are well known in the art. An example of a suitable coating technique is that which is disclosed in U.S. Pat. No. 5,733,428, the disclosure of which is hereby incorporated by reference in its entirety.

The inner cover layer of the present invention, preferably a thin, dense layer, can be formed from a hard, high flexural modulus, resilient material. However, in the most preferred embodiment, the inner cover thin, dense layer is formed from the highly- and fully-neutralized materials described above. Preferably, the inner cover layer has a Shore D hardness of about 60 or greater, preferably about 60-80, and most preferably about 65-70. Furthermore, as defined herein, the term "high flexural modulus" means a flexural modulus (as measured by ASTM 790) of at least about 60,000 psi, preferably about 70,000 psi to about 120,000 psi and most preferably at least about 75,000 psi. The thickness of the inner cover layer can range from about 0.010 inches to about 0.045 inches, preferably about 0.150 inches to about 0.040 inches and most preferably about 0.020 inches.

The inner cover layer may also be formed from a wide variety of hard, high flexural modulus resilient materials. Among the preferred inner cover materials are hard, high flexural modulus ionomer resins and blends thereof. These ionomers are obtained by providing a cross metallic bond to polymers of monoolefin with at least one member selected from the group consisting of unsaturated mono- or di-carboxylic acids having 3 to 12 carbon atoms and esters thereof (the polymer contains 1 to 50% by weight of the unsaturated mono- or di-carboxylic acid and/or ester thereof). More particularly, such acid-containing ethylene copolymer ionomer component includes E/X/Y copolymers where E is ethylene, X is a softening comonomer such as acrylate or methacrylate present in 0-50 (preferably 0-25, most preferably 0-20), weight percent of the polymer, and Y is acrylic or methacrylic acid present in 5-3 5 (preferably at least about 16, more preferably at least about 16-35, most preferably at least about 16-20) weight percent of the polymer, wherein the acid moiety is neutralized 1-90% (preferably at least 40%, most preferably at least about 60%) to form an ionomer by a cation such as lithium*, sodium*, potassium, magnesium*, calcium, barium, lead, tin, zinc* or aluminum (*=preferred), or a combination of such cations. Specific acid-containing ethylene copolymers include ethylene/acrylic acid, ethylene/methacrylic acid, ethylene/acrylic acid/n-butyl acrylate, ethylene/methacrylic acid/n-butyl acrylate, ethylene/methacrylic acid/iso-butyl acrylate, ethylene/acrylic acid/iso-butyl acrylate, ethylene/methacrylic acid/n-butyl methacrylate, ethylene/acrylic acid/methyl methacrylate, ethylene/acrylic acid/methyl acrylate, ethylene/methacrylic acid/methyl acrylate, ethylene/methacrylic acid/methyl methacrylate, and ethylene/acrylic acid/n-butyl methacrylate. Preferred acid containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

The manner in which the ionomers are made is well known in the art. Such ionomer resins are commercially available from DuPont under the tradename SURLYN® and from Exxon under the tradename IOTEK®. Some particularly suitable SURLYNS® include SURLYN® 8140 and SURLYN® 8546, which have a methacrylic acid content of about 19%.

However, the materials for the inner cover layer are not limited to ionomer resins. Instead, the present invention contemplates that virtually any hard, high flexural modulus, resilient material that is compatible with the other materials of the golf ball may be employed as the inner cover layer. Examples of other suitable inner cover materials include thermoplastic or thermoset polyurethanes, thermoplastic or thermoset polyetheresters or polyetheramides, thermoplastic or thermoset polyester, a dynamically vulcanized elastomer, a functionalized styrenebutadiene elastomer, a metallocene polymer or blends thereof.

Suitable thermoplastic polyetheresters include materials, which are commercially available from DuPont under the tradename HYTREL®. Suitable thermoplastic polyetheramides include materials, which are available from Elf-Atochem under the tradename PEBAX®. Other suitable materials for the inner cover layer include nylon and acrylonitrile-butadiene-styrene copolymer (ABS).

Other suitable inner or outer cover materials include any partially- or fully-neutralized ionomer, metallocene or other catalyzed polymers, silicone, other thermoplastic and thermoset elastomers and metal salt of a fatty acid and a melt processible composition comprising a highly neutralized ethylene copolymer and one or more aliphatic, mono-functional organic acids having fewer than 36 carbon atoms of salts thereof, wherein greater than 90% of all the acid of the ethylene copolymer is neutralized. The cover may also comprise a single layer. Alternatively, the cover materials may include a compression molded, injection molded, cast or reaction molded composition comprising a thermoplastic or thermosetting polyurethane or polyurethane copolymer.

To craft a high moment of inertia ball, the cover layers may have high density fillers, such as those described above incorporated therein so long as the cover layers are thin. In other words, one of the cover layers, preferably the inner cover layer, is a thin dense layer. Thin dense layer may have a thickness from about 0.001 inches to about 0.05 inches, more preferably from about 0.005 inches to about 0.030 inches, and most preferably from about 0.005 inches to about 0.015 inches. The thin, dense layer preferably has a specific gravity of greater than about 2.5 g/cc, more preferably greater than about 4.0 g/cc, even more preferably greater than about 6.0 g/cc, and most preferably greater than about 8.0 g/cc. Preferably, the thin dense layer is located as close as possible to the outer surface of the ball. The advantages of locating the thin dense layer as radially outward as possible is discussed in detail above. Preferably, the thin dense layer is located about 0.030 inches to about 0.110 inches from the outer surface of the ball. It is, however, preferable to locate the thin dense layer outside of the centroid radius.

Except for the moment of inertia, the presence of the thin dense layer preferably does not appreciably affect the overall ball properties, such as the feel, compression, coefficient of restitution, and cover hardness. Suitable materials for the thin dense layer include any material that meets the specific gravity and thickness conditions stated above. The thin dense layer is preferably applied to the core as a liquid solution, dispersion, lacquer, paste, gel, melt, etc., such as a loaded or filled natural or non-natural rubber latex, polyurethane, polyurea, epoxy, polyester, any reactive or non-reactive coating or casting material, and then cured, dried or evaporated down to the equilibrium solids level. The thin dense layer may also be formed by compression or injection molding, RIM, casting, spraying, dipping, powder coating, or any means of depositing materials onto the inner core. The thin dense layer may also be a thermoplastic polymer loaded with a specific gravity increasing filler, fiber, flake or particulate, such that it can be applied as a thin coating and meets the preferred specific gravity levels discussed above. One particular example of a thin dense layer, which was made from a soft polybutadiene with tungsten powder using the compression molded method, has a thickness of 0.021-0.025 inches and a specific gravity of 1.31 and a Shore C hardness of about 72.

For reactive liquid systems, the suitable materials include any material which reacts to form a solid such as epoxies, styrenated polyesters, polyurethanes or polyureas, liquid polybutadienes, silicones, silicate gels, agar gels, etc. Casting, RIM, dipping and spraying are the preferred methods of applying a reactive thin dense layer. Non-reactive materials include any combination of a polymer either in melt or flowable form, powder, dissolved or dispersed in a volatile solvent. Suitable thermoplastics are disclosed in U.S. Pat. Nos. 6,149,535 and 6,152,834.

Alternatively, one of the cover layers may be a loaded thin film or "pre-preg" or a "densified loaded film," as described in U.S. Pat. No. 6,010,411 ("the '411 patent) related to golf clubs, may be used as the thin film layer in a compression molded or otherwise in a laminated form applied inside the cover layer 36. The "pre-preg" disclosed in the '411 patent may be used with or without the fiber reinforcement, so long as the preferred specific gravity and preferred thickness levels are satisfied. The loaded film comprises a staged resin film that has a densifier or weighing agent, preferably copper, iron or tungsten powder evenly distributed therein. The resin may be partially cured such that the loaded film forms a malleable sheet that may be cut to desired size and then applied to the outside of the core or inside of the cover. Such films are available from the Cytec of Anaheim, Calif. or Bryte of San Jose, Calif.

Alternative to a high moment of inertia ball and a low moment of inertia ball, a mid-range moment of inertia ball with a relatively large resilient deformation zone can be created. For example, the mid-range ball may comprise a high density inner core 12, a large outer core 14, and thin dense layer 16 and a cover 18. Preferably, the inner core 12 has high density fillers, such as zinc oxide or other filler with specific gravity less than that of tungsten, incorporated in to a polymeric matrix, such as polyurethane or polybutadiene. The thin dense layer positioned radially outside of the centroid radius compensates for the reduction in moment of inertia to produce a mid-range moment of inertia ball.

While various descriptions of the present invention are described above, it is understood that the various features of the present invention can be used singly or in combination thereof. Therefore, this invention is not to be limited to the specifically preferred embodiments depicted therein.

What is claimed is:

1. A golf ball comprising:

a core comprising a highly-neutralized thermoplastic polymer formed from a copolymer of ethylene and an $\alpha,\beta$-unsaturated carboxylic acid, a salt of an organic acid, and sufficient cation source to fully-neutralize the acid groups of the copolymer;

an outer cover layer; and an inner cover layer disposed between the center and the outer cover layer, the inner cover layer having a specific gravity of 2.5 g/cc or greater;

wherein the core has an outer diameter of 1.58 inches or greater and a coefficient of restitution of 0.805 or greater.

2. The golf ball of claim 1, wherein the cation source is selected from a group consisting of metal cations of lithium, sodium, potassium, magnesium, calcium, barium, lead, tin, zinc, and aluminum.

3. The golf ball of claim 1, wherein the salt of an organic acid comprises an organic acid selected from the group consisting of aliphatic organic acids, aromatic organic acids, saturated mono- or multi-functional organic acids, unsaturated mono- or multi-functional organic acids, and multi-unsaturated mono- or multi-functional organic acids.

4. The golf ball of claim 1, wherein the salt of an organic acid comprises stearic acid, behenic acid, erucic acid, oleic acid, linoelic acid or dimerized derivatives thereof.

5. The golf ball of claim 1, wherein the salt of an organic acid comprises a cation selected from the group consisting of barium, lithium, sodium, zinc, bismuth, chromium, cobalt, copper, potassium, strontium, titanium, tungsten, magnesium, cesium, iron, nickel, silver, aluminum, tin, and calcium.

6. The golf ball of claim 1, wherein the specific gravity of the inner cover layer is 6.0 g/cc or greater.

7. The golf ball of claim 1, wherein the outer cover layer is injection molded, cast, reaction injection molded, or compression molded over the core.

8. The golf ball of claim 1, wherein the outer cover layer comprises a polyurethane material, a polyurea material, a polyurethane-urea hybrid material, or a polyurea-urethane hybrid material.

9. The golf ball of claim 1, wherein the core outer diameter is 1.58 inches to 1.62 inches.

10. The golf ball of claim 9, wherein the core outer diameter is 1.59 inches.

11. The golf ball of claim 1, wherein the inner cover layer has a thickness of 0.005 inches or greater.

12. The golf ball of claim 11, wherein the inner cover layer thickness is between 0.005 inches and 0.015 inches.

13. The golf ball of claim 1, wherein the core has an Atti compression of 75 to 85.

14. The golf ball of claim 1, wherein the core has a Shore D hardness of 42 to 48.

15. The golf ball of claim 1, wherein the core comprises a center and an outer core layer.

16. The golf ball of claim 1, wherein the inner cover layer comprises a thermoset or thermoplastic material.

17. The golf ball of claim 1, wherein the inner cover layer comprises a highly-neutralized thermoplastic polymer formed from a copolymer of ethylene and an α,β-unsaturated carboxylic acid, a salt of an organic acid, and sufficient cation source to fully-neutralize the acid groups of the copolymer.

18. The golf ball of claim 1, wherein the inner cover layer has a Shore D hardness of 60 or greater.

19. A golf ball comprising:

a core comprising a center and an outer core layer, both the center and outer core layers comprising a highly-neutralized thermoplastic polymer formed from a copolymer of ethylene and an α,β-unsaturated carboxylic acid, a salt of an organic acid, and sufficient cation source to fully-neutralize the acid groups of the copolymer;

an outer cover layer; and an inner cover layer disposed between the center and the outer cover layer, the inner cover layer having a specific gravity of 4.0 g/cc or greater;

wherein the core has an outer diameter of 1.58 inches or greater and a coefficient of restitution of 0.805 or greater.

20. A golf ball comprising:

a core having a first specific gravity and comprising a highly-neutralized thermoplastic polymer formed from a copolymer of ethylene and an α,β-unsaturated carboxylic acid, a magnesium salt of an organic acid, and sufficient cation source to fully-neutralize the acid groups of the copolymer;

a outer cover layer comprising a castable polyurea, polyurethane, or a mixture thereof, and having a thickness of 0.005 inches to 0.015 inches and a Shore D hardness of 60 or greater; and an inner cover layer disposed between the center and the outer cover layer, the inner cover layer comprising the highly-neutralized thermoplastic polymer and having a second specific gravity at least 5 times greater than the first specific gravity;

wherein the core has an outer diameter of 1.58 inches to 1.62 inches and a coefficient of restitution of 0.810 or greater.

* * * * *